US005771880A

United States Patent [19]

Tsai

[11] Patent Number: 5,771,880

[45] Date of Patent: Jun. 30, 1998

[54] MULTIPURPOSE GAS BURNER

[76] Inventor: Chin-Lin Tsai, 3F, No. 94, Sec. 4, Chung Hsin Rd., San Chung City, Taipei Hsien, Taiwan

[21] Appl. No.: 553,975

[22] Filed: Nov. 6, 1995

[51] Int. Cl.[6] ..... F23D 14/62; F23Q 7/12

[52] U.S. Cl. ..... 126/414; 431/255; 431/345

[58] Field of Search ..... 431/344, 345, 431/255; 126/414, 413, 406

[56] References Cited

U.S. PATENT DOCUMENTS

| | | | |
|---|---|---|---|
| 4,552,124 | 11/1985 | Nakajima | 126/413 |
| 4,641,632 | 2/1987 | Nakajima | 126/413 |
| 5,082,440 | 1/1992 | Yamamoto | 431/143 |
| 5,490,496 | 2/1996 | Lin | 431/255 |
| 5,531,592 | 7/1996 | Tsai | 431/255 |
| 5,620,318 | 4/1997 | Tsai | 431/344 |

*Primary Examiner*—Carl D. Price

*Attorney, Agent, or Firm*—Bucknam and Archer

[57] ABSTRACT

A multipurpose gas burner includes a rear housing, a front housing, a pressure regulating device, a control device, a gas release device and an outer tube unit. The rear housing contains a conventional gas container and is provided with a press rod and an insert nozzle connected to a gas spout of the gas container. Upon pressing a push button, a lower slide seat will press against a piezo-electric device while an upper slide seat is relatively displaces to cause the press rod to press against the gas spout of the gas container to release fuel gas. The pressure regulating device regulates the pressure of the fuel gas and controls its outflow. The regulated fuel gas is ejected via a gas nozzle into the gas release device where it is mixed with air drawn in from the outside. The mixture is then ejected by a fire nozzle and is ignited by sparks generated by means of the piezo-electric device at the outer tube unit. A heating tube may be further fitted to the gas burner to form a heating device, and a soldering iron may be additionally fitted onto the heating tube for soldering purposes.

10 Claims, 8 Drawing Sheets

MULTIPURPOSE GAS BURNER

BACKGROUND OF THE INVENTION (a) Field of the Invention

The present invention relates to a gas burner, and more particularly to a multipurpose gas burner.

(b) Description of the Prior Art

It is well known that lighters provide intermittent ignition. In lighting a cigarette, for instance, a press button of the lighter is pressed briefly to allow outflow of gas to generate a flame. When the button is released, gas outflow is cut off and the flame goes out. In terms of safety and energy conservation, the conventional lighter is quite effective.

However, under circumstances as in welding where longer period of ignition is required, conventional lighters are inapplicable. The reasons are that the user has to keep on pressing the button of the lighter with his/her thumb which may soon feel tired and that the thumb may be easily hurt by the flame. Besides, once the button is released, the flame will immediately go out.

In U.S. Pat. No. 5,082,440 to the inventor of the present invention and allowed U.S. Ser. No. 08/203,334 also filed by the inventor, a handy gas torch is disclosed in which fuel gas is made to pass through a gas release device and a burning device before being ignited by means of a piezo-electric device.

In addition, portable gas welding torches are convenient to carry anywhere so that they are capable of replacing conventional electric welding guns.

U.S. Pat. Nos. 4,552,124 and 4,641,632 disclose a gas welding gun which is ignited manually. After a gas switch of the welding gun is turned on, an operator has to use a separate lighter or a lighting device disposed in the welding gun to ignite the fuel gas at a front end of the welding gun in order to heat a soldering iron head. As the operator has to hold the welding gun with one hand and hold the lighter or lighting device to ignite the flame with the other, it is inconvenient to use. Efforts have been made to eliminate the drawback, and there are available in the marketplace electronically ignited welding guns which, in use, require the mere pressing of an ignition push button on the welding gun and are therefore quite convenient to use. However, in the above-mentioned prior art, a gas tank has to be mounted at a rear end of the welding gun so that gas may be refilled when the gas is consumed. But since gas containers have fixed sizes, they are inconvenient to carry.

SUMMARY OF THE INVENTION

A primary object of the present invention is to provide a multipurpose gas burner which may be used in burning, welding, heating and soldering.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
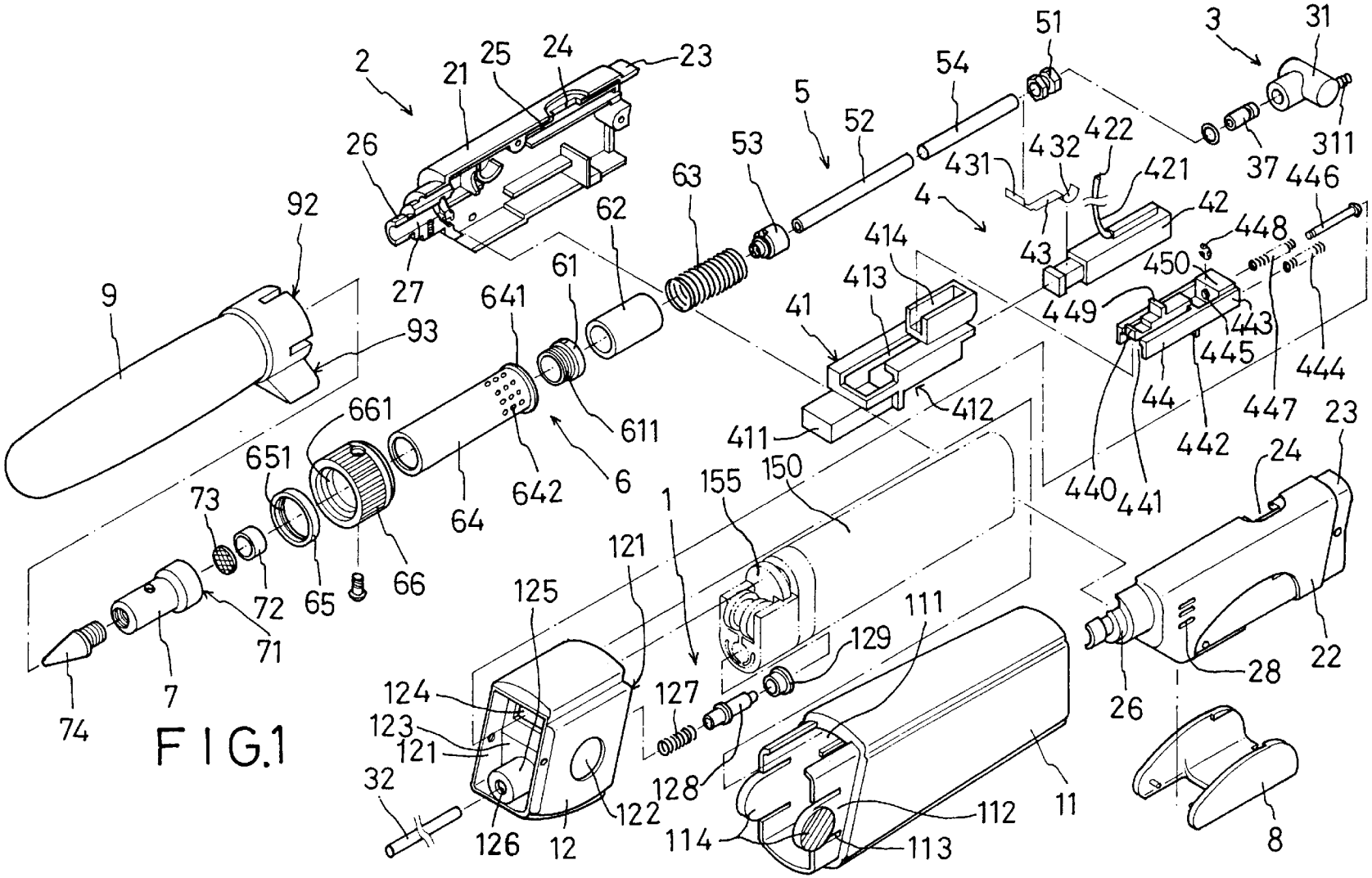
FIG. 1 is a perspective exploded view of the gas burner according to the present invention.

With reference to the drawings, the multipurpose burner according to the present invention essentially comprises a rear housing 1, a front housing 2, a pressure regulating device 3, a control device 4, a gas release device 5 and an outer tube unit 6.

Figure 2:
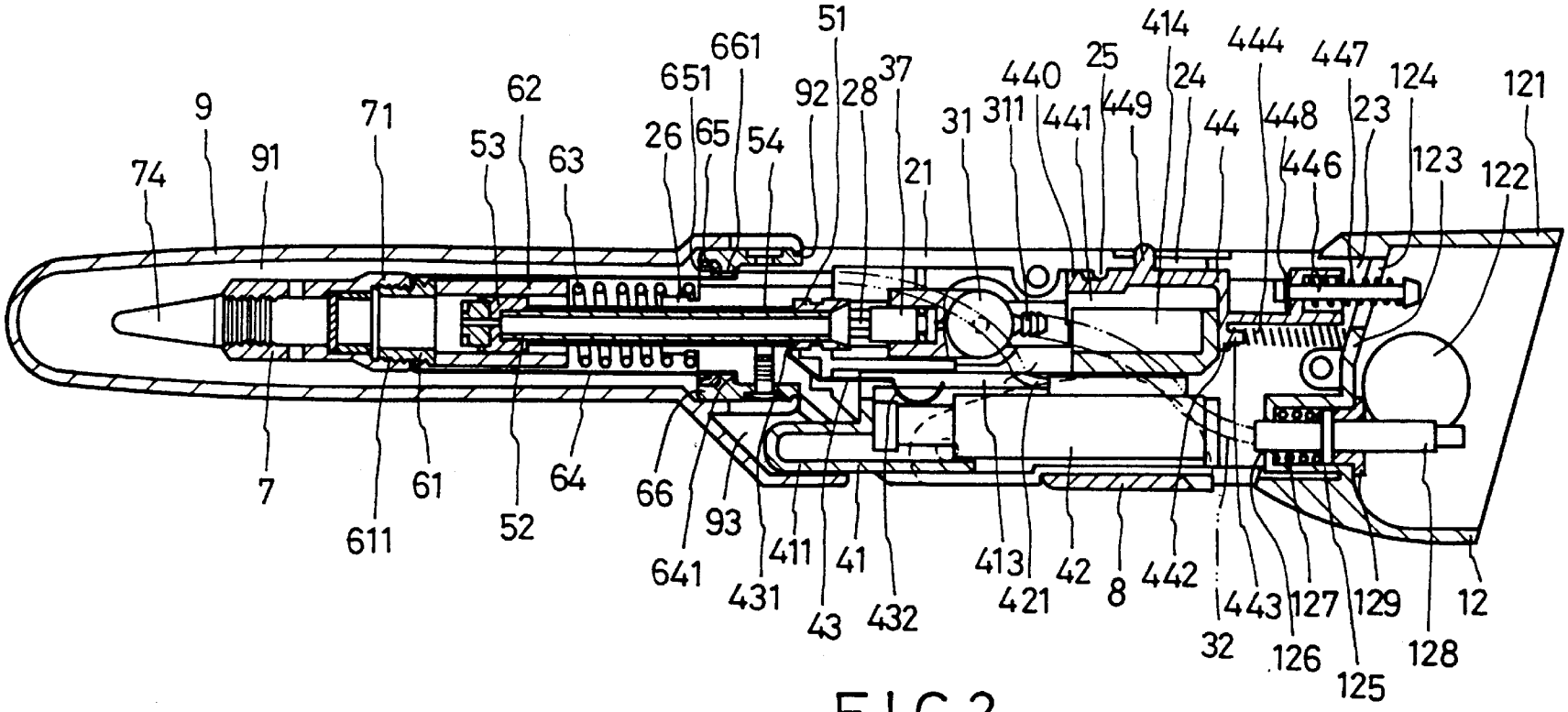
FIG. 2 is a partially sectional schematic view of the gas burner of the present invention in an assembled state.

With reference to FIGS. 1 and 2, the rear housing 1 consists of a rear housing portion 11 and a relay seat 12 joined together. The rear housing portion is an elongate enclosed structure with an open end and has a compartment 111 formed in a central portion for fitting a conventional disposable lighter (as shown by imaginary lines) or a refillable gas lighter (to be referred to as gas container 150 hereinbelow). Two parallel rear housing plates 112 further extend from a front rim of the compartment 111 for coupling with the relay seat 12. In order to ensure that the rear housing 11 and the relay seat 12 are properly coupled together, a couple of slots 113 are on each of the two rear housing plates 112 for defining a space for fitting a protruding round push button 114 which may be fitted into a corresponding hole (122) in the relay seat 12.

The relay seat 12 is a hollow structure having a rear seat hole 121 at a rear end for receiving the rear housing plates 112 and another hole 121 in the front end for connecting with the rims3 of the front housing. Two holes 122 are respectively formed in the relay seat 12 at positions matching those of the two push buttons 114 of the rear housing 1. The relay seat 12 is further provided with a partition 123 having a rectangular through hole 124 at an upper portion for passage of a pressing rod 446 (to be described hereinbelow) therethrough, while the lower portion thereof is provided with a seat post 125 having a central bore 126 which receives in turn a spring 127, an insert nozzle 128 and a stop seat 129. The insert nozzle 128 is passed through the spring 127 such that one end thereof projects from the bore 126 to be connected via a hose 32 with the pressure regulating device 3. The other end of the insert nozzle is connected with the gas spout 160 of the gas container 150. The stop seat 129 is then fitted onto the insert nozzle 128 so that the insert nozzle 128 may not be ejected from the seat post 125. After the rear housing 1 together with the gas container is fitted onto the relay seat 12, the insert nozzle 128 is connected to a gas spout of the gas container. Since the size of the gas spout in conventional gas containers varies, the spring 127 within the seat post 125 provides resilience for the insert nozzle 128 to retreat into the seat post 125 if the gas spout of the gas container is too long and ensures that the insert nozzle 128 is always connected to the gas spout of the gas container.

The front housing 2 consists of a left housing 21 and a right housing 22 of symmetrical structure joined together face-to-face. Both the left and right housings 21, 22 are respectively provided with recesses and posts for fitting and positioning the pressure regulating device 3 and the control device 4 (to be described hereinbelow). When the left and right housings 21, 22 are joined together, the housing rims 23 at rear ends thereof fit into a front seat hole 121 of the relay seat 12 and are locked together by means of screws. Additionally, the front housing 2 is provided with an upper opening 24 through which a button 449 of the control device 4 extends. An upper post 25 is further provided on an inner wall extended from a lower portion of the upper opening 24 for coupling with an upper slide seat 44. Besides, the front end of the front housing 2 is a tiered portion 26 for coupling with a plastic connecting ring 66 of the outer tube unit 6. The tiered portion 26 has a through hole 27 for passage of the gas release device 5 therethrough. Moreover, in order to ensure that ambient air may be drawn into the front housing 2 to be mixed with the fuel gas, a plurality of air vents 28 are formed in the left and right housings 21, 22 for matching those on the gas nozzle 37, to be described hereinafter.

Figure 3:
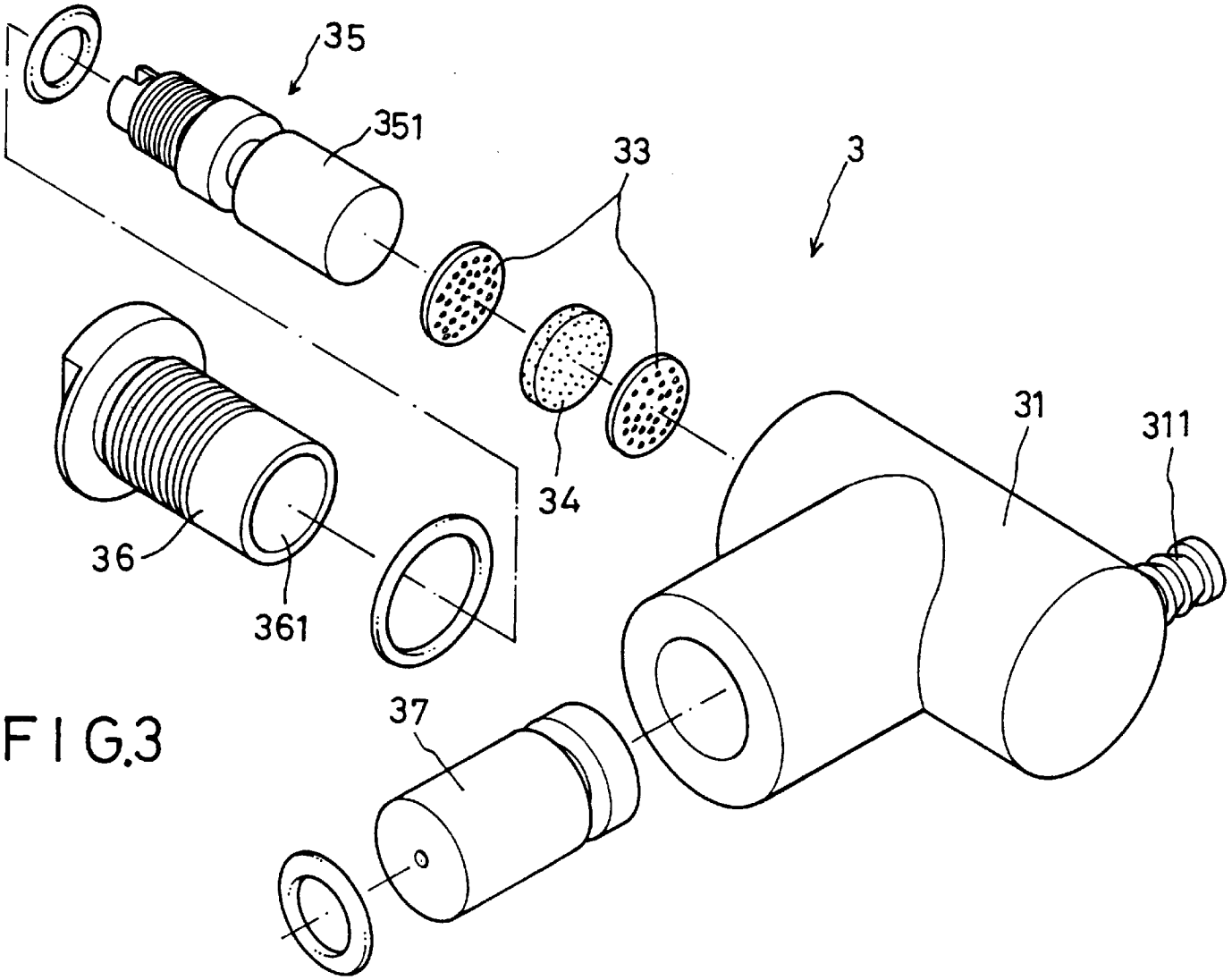
FIG. 3 is a perspective exploded view of a pressure regulating device of the present invention.
Figure 4:
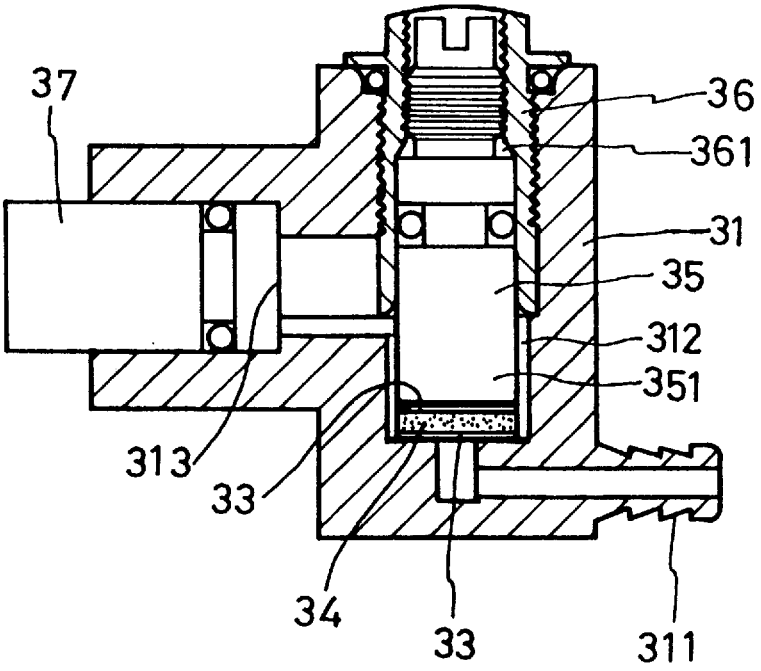
FIG. 4 is a sectional view of the pressure regulating device of the present invention.

With reference to FIGS. 3 and 4, the pressure regulating device 3 mainly includes a T-shaped pressure regulator 31 having a rear end thereof provided with an intake rod 311 which is connected via the hose 32 to the insert nozzle 128. The pressure regulator 31 has a gas path 312 defined therein for fitting thereon a sponge 34 disposed between two copper plates 33 having a plurality of fine holes, a regulating threaded rod 35 and a knob 36. The knob 36 includes a hollow rod 361 provided with a section of threads for receiving the regulating threaded rod 35 and locking therewith. Since the regulating rod 35 is provided with a rod section 351 having a diameter smaller than the gas path 312, fuel gas may escape via clearances formed therebetween through a tiered hole 313. When the regulating threaded rod 35 is turned, the rod section 351 at the front end thereof will press against the copper plates 33 and the sponge 34 disposed therebetween to alter the density of the sponge 34 so as to control the flow speed of fuel gas into the gas path 312, thereby regulating the pressure as well as promoting the gasification of the fuel gas. The burning intensity at the gas release device 5 may also be controlled in this manner. Besides, the tiered hole 313 is internally coupled with a gas nozzle 37 so that fuel gas may be ejected via the gas nozzle 37 and induced into the gas release device 5 together with air drawn in via the air vents 28 at both sides of the front housing 2.

Figure 5:
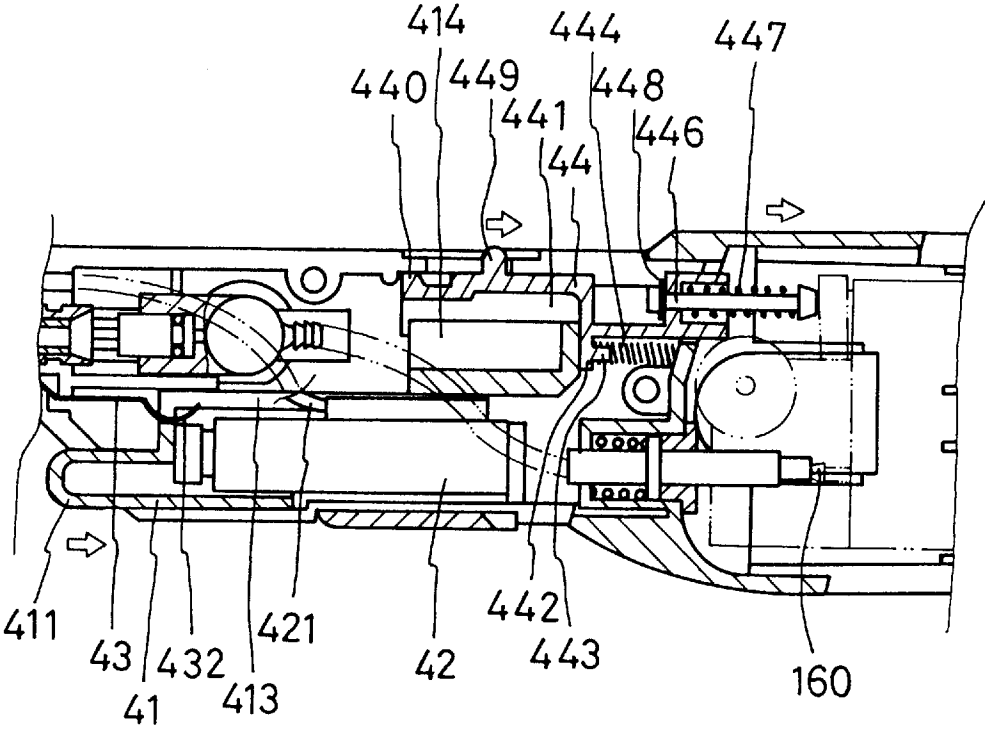
FIG. 5 is a schematic view illustrating the operation of a control device of the present invention.
Figure 6:
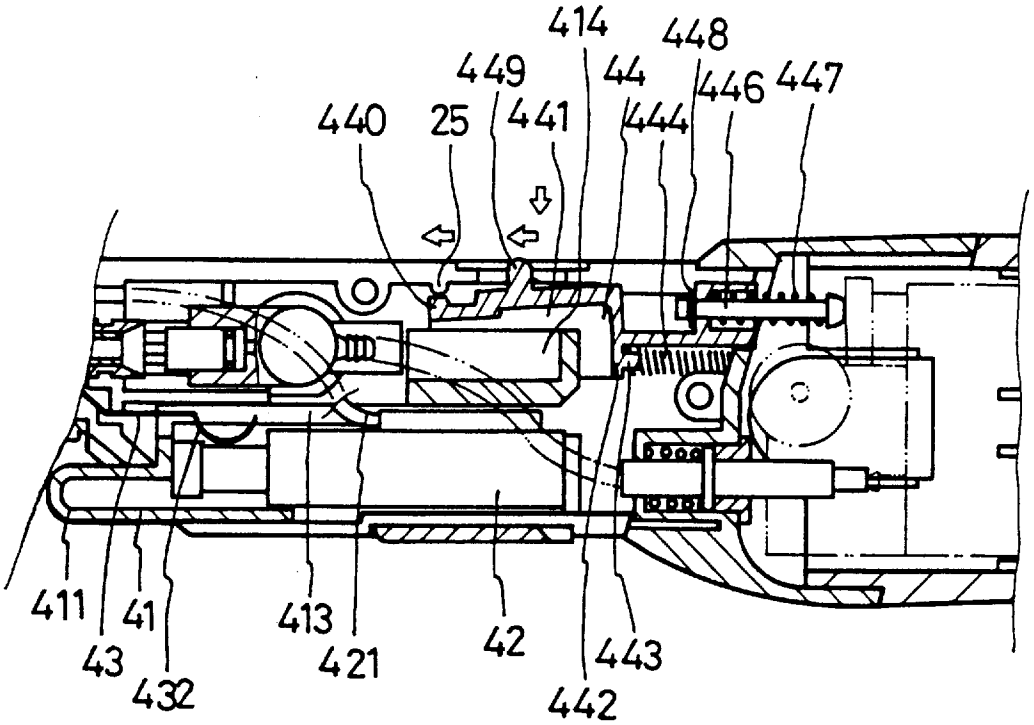
FIG. 6 is a schematic view showing the reset of the control device of the present invention.

Referring to FIGS. 1, 5 and 6, the control device 4 consists of a lower slide seat 41, a piezo-electric device 42, a conductive piece 43 and an upper slide seat 44 and is placed within the front housing 2. The lower slide seat 41 has a front end extending to form an elongated push button 411 and a rear end provided with a slide slot 412 for receiving the piezo-electric device 42 and urging against a front rim of the piezo-electric device 42. A groove 413 is provided in a horizontal upper side of the upper slide 412 for passage of a lead wire 421 of the piezo-electric device 42 therethrough. The groove 413 has a rear end extending and upwardly to from an U-shaped slot 414 for receiving the upper slide seat 44 which may move along the groove 413. A stop piece 415 is further provided at a rear end of the U-shaped slot for urging against the upper slide seat 44 to permit linking-up movement.

The piezo-electric device 42 is a well known one in the art. It is placed within the lower slide slot 412 with the lead wire 421 at its upper side extending through the groove 413. A wire end 422 extends to the area between a metal extension tube 64 and the connecting ring 66 for forming a connected circuit.

The conductive plate 43 is a bent metal plate structure which has one end thereof held by the gas release device 5 and a curved portion 432 at a lower end connected to a metal bar portion of the piezo-electric device 42.

The slide seat 44 has a slide track 441 at its bottom for coupling with the U-shaped slot 414 so that the upper slide seat 44 may slide along the slide track 441. And in order that the upper slide seat 44 is linked up with the lower slide seat 41, a front end of the slide track 441 extends downwardly to form a baffle piece 442 for urging against the stop piece 415. A rear end of the baffle piece 442 is provided with a horizontally extending post 443 which has fitted thereon a second spring 444 which has one end thereof urging against a the position 123 of the relay seat 12, so that the upper slide seat 44 may be reset by means of the resilience of the second spring 444. And in order that the upper slide seat 44 may synchronously control a press plate of the gas container, a through hole 445 may be provided at its rear end. The pressing rod 446 of the control device 4 has a third spring 447 fitted thereon and has one end thereof inserted into the through hole 445 to be positioned by a C-clip 448 and the other end is capable 155 of urging against the press plate 155 of the gas container when the upper slide seat 44 moves rearwardly, so that fuel gas may be released from the gas spout of the gas container. In addition, an elastic 450 piece is provided at an upper side of the slide track 441, and a lug 449 is provided to project from the upper opening 24 of the front housing 2. A hook 440 is further provided at a front end of the elastic piece so that when the upper slide seat 44 remains stationary, it is fastened with the upper post 25 of the front housing 2, and when the upper slide seat 44 moves rearwardly, it urges against the upper post 25 to prevent the upper slide seat 44 from resetting to its original position so as to enable the pressing rod 446 to keep on urging against the press plate 155 of the gas container.

The gas release device 5 mainly includes an I-shaped gas receiving ring 51 for receiving fuel gas ejected via the gas nozzle 37 and air drawn in via the air vents 28. The mixture then passes through an inner tube 52 located at the through hole 27 of the front housing 2 to be ejected via a fire nozzle 53. And in order to prevent the inner tube 52 from melting, it is fitted with an insulating sleeve 54.

The outer tube unit 6 consists of, in sequence, a positioning ring 61, a ceramic tube 62 and a fourth spring 63 placed within the metal extension tube 64. The positioning ring 61 is riveted together with the extension tube 64, and the fourth spring 63 is fitted onto the tiered portion 26 of the front housing 2 such that the fourth spring 63 urges against the ceramic tube 62 which is thereby positioned. The inner tube 52 and the outer tube 54 are passed through the fourth spring 63 while the fire nozzle 53 is placed within the ceramic tube 62. A metal insulating ring 65 is then fitted into the plastic connecting ring 66, both of which are fitted onto the extension tube 64 such that a flange 661 of the connecting ring 66 urges against the rear rim 641 of the extension tube 64. At the same time, the wire end 422 of the piezo-electric device 42 is gripped between the connecting ring 66 and the extension tube 64 and is in contact with the rear rim 641 of the connecting ring 66 to connect the electrical circuit. The heat insulating ring 65 is provided with an inwardly oriented flange 651 at its rear end which has a small-area contact with the extension tube 64 for preventing the heat generated by the extension tube 64 to reach and melt the connecting ring 66. Additionally, in order that the air may enter into the extension tube 64 to promote combustion, a plurality of air vents 642 may be formed in the extension tube 64.

In actual operation, the above-mentioned components are assembled together in the order described with the push button 411 projecting from a lower portion of the front housing 2. When the push button 411 is pressed, the lower slide seat 41 is displaced, and the piezoelectric device 42 is pushed into a contracted state so that the upper slide seat 42 located above the U-shaped slot 414 is caused be displaced rearwardly as a result of the stop piece 415 pushing the baffle piece 442. In consequence, the baffle piece presses the second spring 444, causing the hook 440 above to disengage therefrom along the inclined surface of the upper post 25 of the front housing 2. At this time, the upper slide seat 44 will be subjected to the resilience of the second spring 444 and is caused to be displaced, causing a straight portion in front of the hook 440 to urge against the upper post 25 of the front housing 2. Then the lower slide seat 41 is subjected to the resilience of the piezo-electric device 42 and returns to its original position along a pre-determined path. At the same time, the pressing rod 446 at the rear end of the upper slide seat 44 also presses against the press plate 156 of the gas container during the course of displacement, so that fuel gas is emitted via the gas spout of the gas container and passes through the insert nozzle 128, hose 32 and pressure regulator 31 and out via the gas nozzle 37. The currents generated by the fuel gas induce air via air vents 28 into the receiving ring 51. The mixture of gas and air then flows through the inner tube 52 and is ejected via the fire nozzle 53. Meanwhile, static electricity generated by the piezoelectric device 42 passes through the wire end 422 and the extension tube 64 to produce sparks at the positioning ring 61 to ignite the mixture ejected by the fire nozzle 53. In the present invention, the conducting path is constituted by the fire nozzle 53, the conductive plate 43 gripped between the connecting ring 51 and the inner ring 52, as well as the metal bar portion of the piezo-electric device 42.

When not in use, it is only necessary to press the lug 449 to cause the straight portion at the front end of the hook 440 to be displaced longitudinally to below the upper post 25 of the front housing 2 so that the second spring 444 will generate counter-action against the baffle piece 42, causing the upper slide seat 44 to be displaced forwardly while the hook 440 moves towards the upper post 25 of the front housing 2 to fasten therewith. At this time, the pressing rod 446 retracts, releasing the press plate 155 of the gas container so that fuel gas stops coming out of the gas spout. The flame at the fire nozzle 53 is therefore extinguished.

In a preferred embodiment of the present invention, a front end of the extension tube 64 may be connected to a heating tube 7 which has threads 71 formed at a rear portion thereof and capable of engaging with threads 611 formed at a front portion of the positioning ring 61. The front portion of the positioning ring 61 further positions a securing ring 72 and an annular mesh 73 disposed within the heating tube 7, so that the flame sent out via the fire nozzle 53 may only heat the annular mesh 73 without burning therethrough. The hot current thus generated is released through an opening in a front end of the heating tube 7. Such an embodiment may be adopted in heating to-be-processed workpieces such as plastic materials.

Figure 7:
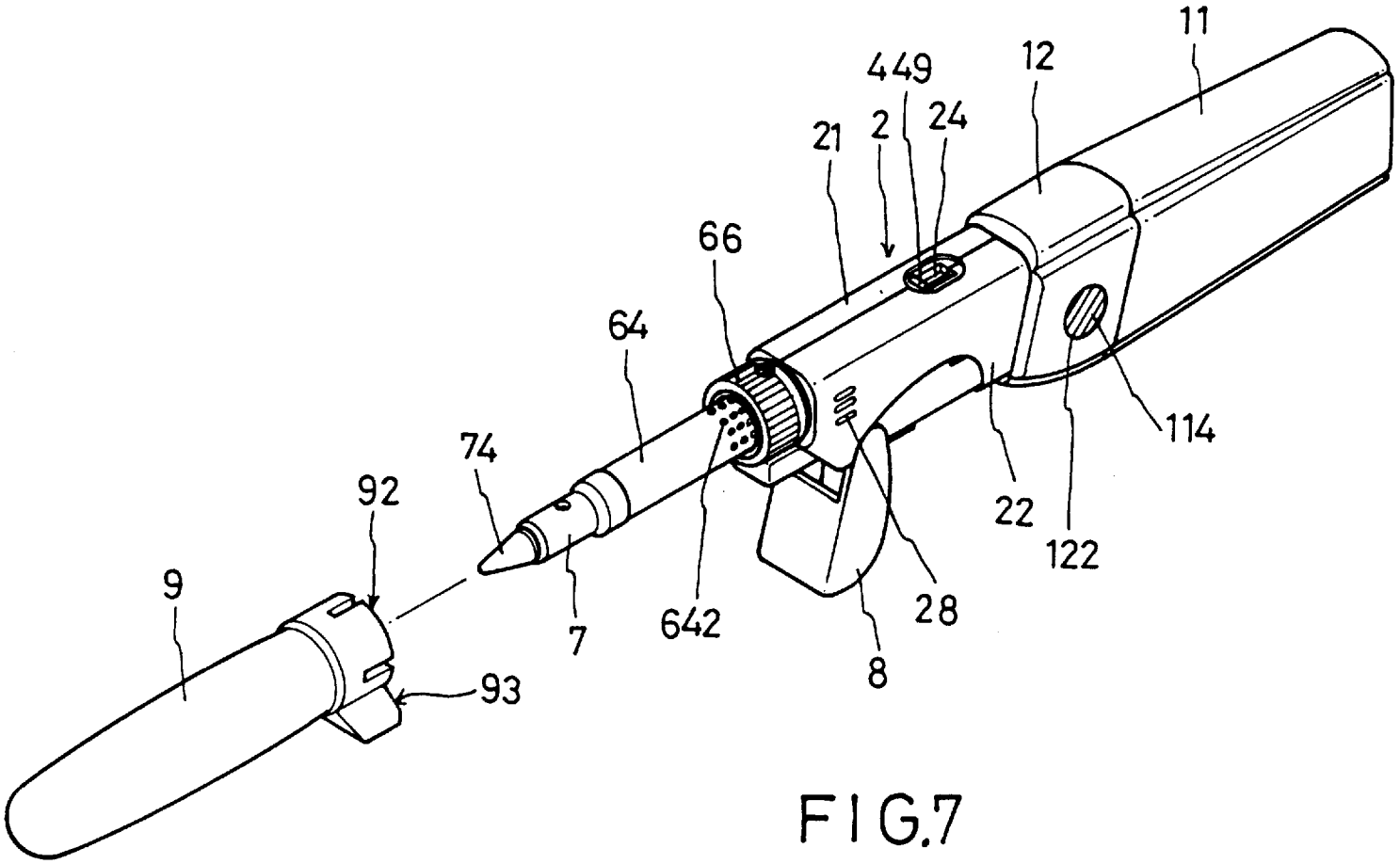
FIG. 7 is a schematic view of the gas burner in an assembled state before a jacket is fitted onto it.

In a further embodiment of the present invention, as shown in FIGS. 1 and 7, the heating tube 7 may be connected to a soldering iron head 74 at its front end for heating the soldering iron head 74 by means of the hot air generated.

In still another embodiment of the present invention, a leg support 8 may be insertably fitted to a lower portion of the front housing 2 for supporting the gas burner of the invention when the iron head 74 is being heated or when the burner is temporarily not used.

Figure 8:
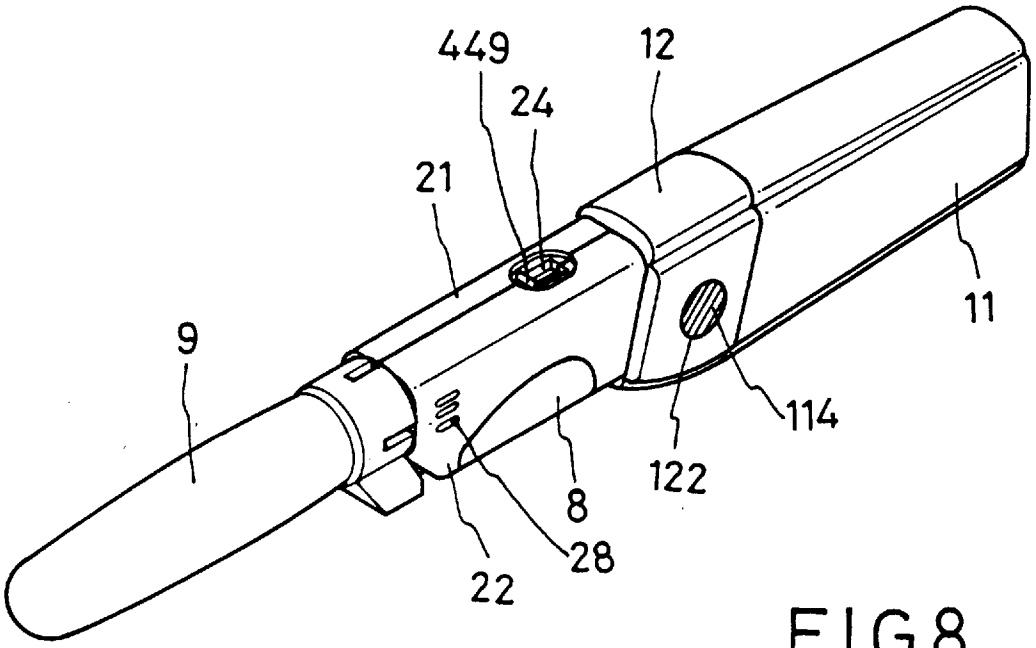
FIG. 8 is a perspective schematic view of the gas burner in an assembled state.

With further reference to FIGS. 1 and 8, a jacket 9 having an opening at its rear end may be fitted onto the outer tube unit 6 and the heating tube 7 as a means of protection. The jacket 9 has a hollow 91 provided with a hook element 92 orienting inwardly at its rear end for engaging the connecting ring 66. A cover element 93 is provided to extend horizontally from a lower portion of the hook element 92 for concealing the push button 411 so as to prevent inadvertent pressing of the push button 411.

Advantages of the gas burner of the present invention are enumerated below:

1. The gas burner of the present invention is easy to operate. By simply pressing the push button, the lower slide seat is caused to urge against the piezo-electric device, and the upper slide seat is also simultaneously caused to be displaced so that its pressure post pushes the press plate 155 of the gas container to release fuel gas.

2. Gas supply may be conveniently cut off. By simply pressing a lug on the control device to cause a spring to reset and a pressure post to retract, the press plate 155 of the gas container is released to cut off supply of fuel gas.

3. Burning intensity may be controlled. The arrangement of a pressure regulating device not only facilitates the adjustment of the fuel gas pressure but also promotes gasification and regulates the outflow of fuel gas, hence controlling the intensity of the flame.

4. Replacement of the gas container is easy. Since the rear housing and the relay seat can be easily assembled or disengaged from each other and since the gas container may be a conventional disposable lighter, the gas burner of the present invention is more convenient in terms of supply of fuel gas than the conventional gas burner wherein refilling of fuel gas is inconvenient.

5. The gas burner of the present invention has multiple purposes. In addition to having the known functions of a gas burner, the multipurpose gas burner of the present invention may be used as a heating device when fitted with a heating tube and may also be used as a gas soldering iron when fitted with an iron head.

6. The gas burner of the present invention is provided with a collapsible leg support which may be used to support the gas burner on a table without the need to hold the burner in the hand when in use.

7. The gas burner of the present invention is provided with a protective jacket which may be fitted on the iron head to conceal the push button to prevent accidents.

Although the present invention has been illustrated and described with reference to the preferred embodiment thereof, it should be understood that it is in no way limited to the details of such embodiment but is capable of numerous modifications within the scope of the appended claims.

What is claimed is:

1. A multipurpose gas burner comprising a rear housing (1), a front housing (2), a pressure regulating device (3), a control device (4), a gas release device (5) and an outer tube unit (6);

said rear housing (1) consisting of a rear housing portion (11) and a relay seat (12), said rear housing portion (11) and a relay seat (12) being joined to each other, said rear housing portion (11) having an elongated structure, an open end, a central portion, a compartment (111) formed in said central portion, a gas container (150) fitted into said compartment, said compartment (111) having a front rim, two parallel housing plates (112) extending from said front rim for coupling with said relay seat (12), each of said two parallel housing plates (112) having a slot (113), two round push buttons (114) fitted into each of said slots and protruding from said rear housing, said relay seat (12) having one hole (121) in a rear portion thereof and one hole (121) in a front portion thereof, said rear housing plates (112) entering into said hole (121) located in the rear portion of said relay seat (12) after assembly, said relay seat (12) having two second holes (122) located on opposite sides thereof, said two push buttons (114) of said rear housing each entering into one of said second holes (122), said relay seat (12) having a partition (123), a rectangular through-hole (124) adjacent said partition, a seat post (125) located on said partition, said seat post (125) having a central bore (126), said gas container (150) having a spout (160) and a press plate (155), an insert nozzle (128) received into said central bore (126), after assembly, said insert nozzle being connected to said gas spout of said gas container after said rear housing (1) containing the gas container is fitted onto said relay seat (12);

said front housing (2) consisting of left housing (21) and right housing (22) of symmetrical structure and joined together face to face, each of said left housing (21) and right housing (22) having a rim (23) at a rear end thereof, each rim engaging with said hole (121) located in the front portion of said relay seat (12), each of said left housing (21) and right housing (22) having an opening (24) in to upper part thereof, said opening having a lower portion, said left and right front housing having an upper post (25) on an inner wall extended from a lower portion of said upper opening (24), said front housing (2) having at a front thereof a tiered portion (26), said tiered portion (26) having an opening (27), said front housing (2) having a plurality of vents (28) for entry of ambient air, said pressure regulating device (3) comprising a T-shaped pressure regulator (31) having a rear end and a front end, said pressure regulator rear end being connected to said insert nozzle (128) which is connected to said relay seat (12), said pressure regulator front end being provided with a gas nozzle (37) for ejecting fuel gas, said pressure regulating device having means for regulating the pressure of said fuel gas;

said control device (4) consisting of a lower slide seat (41), a piezo-electric device (42), a conductive plate (43) and an upper slide seat (44), a pressing rod (446) and a through hole (445) formed in said upper slide seat (44), said piezo-electric device having a rim and a wire end (422), said lower slide seat (41) having a front end extending to form an elongate push button (411) and a rear end provided with a slide slot (412), said rim of said piezo-electric device entering into said slot (412), said slot having a horizontal upper side, said slot (412) having a groove (413) in said horizontal upper side of said slot, said groove having a rear end thereof extending upwardly to form an U-shaped slot (414) for receiving said upper slide seat (44), said U-shaped slot (414) being provided with a stop piece (415) at the rear end of said U-shaped slot (414) said conductive plate (43) having two ends, one end thereof being connected to said gas release device (5) and the other end being connected to said piezo-electric device, said upper slide seat (44) having a slide track (441) at to a bottom portion thereof for coupling with said U-shaped slot (414) whereby said upper slide seat (44) slides along said slide track (441), said upper slide seat (44) having a baffle piece (442) at a lower portion thereof for urging against said stop piece (415), said baffle piece having a rear end, said rear end of said baffle piece being provided with a horizontally extending post (443), said post having fitted thereon a spring (444), said upper slide seat (44) having a through hole (445) formed at a rear end thereof, said pressing rod (446) being fitted with a spring element (447) having one end thereof inserted into said through hole (445) of said upper slide seat, said pressing rod (446) being positioned by a C-clip (448), at one end thereof, said gas container (150) having a press plate (155), the other end of said pressing rod (446) urging against said press plate of the gas container, after assembly, an elastic piece (450) being further provided in front of said through hole (445) of said upper slide seat, said elastic piece having a hook (440) provided at a front end thereof for engaging with or disengaging from said upper post (25) of said front housing, a lug (449) being provided to project from said front opening (24) of said front housing;

said gas release device (5) consisting of an inner tube (52), a fire nozzle (53) and a receiving ring (51) for receiving fuel gas ejected via said gas nozzle (37) and air drawn in via said air vents (28), said conductive plate (43) of said piezo-electric device (42) being in contact with said receiving ring (51) and said inner tube (52) whereby a mixture of fuel gas and air passes through said inner tube (52) after assembly to be ejected via said fire nozzle;

said outer tube unit (6) consisting of a positioning ring (61), a ceramic tube (62), a connecting ring (66), a heat insulating ring (65), an extension tube (64) and spring means (63), said piezo-electric device (42) having a wire end (422), said connecting ring (66) having a flange (661), said positioning ring (61), said ceramic tube (62) and said spring means (63) being all disposed within said extension tube (64), said fire nozzle (53) and said inner tube (52) being located in said ceramic tube and in said spring means (63) and being connected with said extension tube (64) by means of said connecting ring (66), said extension tube (64) having a rear rim (641), said wire end (422) of said piezo-electric device being gripped between said flange (661) of said connecting ring and said rear rim (641) of said extension tube, and said connecting ring (66) being locked with said tiered portion (26) of said front housing.

2. The multipurpose gas burner as claimed in claim 1 wherein said gas container is selected from a disposable and refillable lighter.

3. The multipurpose gas burner as claimed in claim 1 which comprises a spring (127) and a stop seat (129), said spring, said insert nozzle (128) and said stop seat (129) go through said central bore (126) in said relay seat (12) and one end of said insert nozzle projects from said central bore for connection to said pressure regulating device (3).

4. The multipurpose gas burner as claimed in claim 1 wherein said means for regulating the pressure in said pressure regulating device includes a (31) rear end of said pressure regulating device provided with an intake fitting (311), said intake fitting being connected to said insert nozzle (128), said pressure regulator further comprises a sponge (34), two copper plates (33), said plates having a plurality of holes, a regulating threaded rod (35), a knob (36), a hollow rod (361) being provided on said knob (36), said pressure regulator (31) having a gas path (312) defined in said insert nozzle (128) for disposing said sponge, said sponge being placed between said two copper plates, said regulating rod (35) being provided with a rod section (351) at a front end thereof, said rod section (351) having a diameter smaller than said gas path (312), said regulating threaded rod (35) being turned during assembly to press against said copper plates and said sponge whereby the density of said sponge varies whereby the flow speed of fuel gas and the pressure into said gas path is controlled.

5. The multipurpose gas burner as claimed in claim 1 wherein said inner tube (52) of said gas release device (5) is provided with an insulating sleeve (54) whereby melting of said inner tube is prevented.

6. A multipurpose gas burner as claimed in claim 1 wherein said heat insulating ring (65) has a flange (651) at a rear end thereof, said connecting ring (66) has a flange (651), said extension tube (64) having a rear rim (641), said flange (651) being inwardly oriented and allowing a small-area contact with said extension tube (64) to prevent melting the said connecting ring.

7. The multipurpose gas burner as claimed in claim 6 wherein said extension tube (64) has a front end and is provided with a plurality of air vents (642) for passage of ambient air into said extension tube (64) and a multipurpose gas burner additionally comprises a threaded heating tube (7), said heating tube (7) having threads (71) at a rear end thereof, said positioning ring (61) having a front portion, said threads (611) engaging with said threads (71) located at the rear end of said heating tube (7), said positioning ring (61) having a front portion, said front portion positioning both a securing ring (72) and an annular mesh (73) said securing ring (72) and said mesh (73) being located within said heating tube, said positioning ring being engaged with said heating tube (7) whereby flame ejected via said fire nozzle (53) heats said annular mesh to generate a hot current, said heating tube (7) has a front end and an opening in said heating tube front end, and said hot current is released through said front end opening.

8. The multipurpose gas burner as claimed in claim 7 wherein said front end of said heating tube is connected to a soldering iron head (74).

9. The multipurpose gas burner as claimed in claim 8 wherein said front housing (2) has a lower portion and a rotary leg support (8) is mounted below said front housing (2).

10. The multipurpose gas burner as claimed in claim 1 wherein said outer tube unit (6) is provided with a jacket (9), said jacket has a cover (93) for concealing said push button (411) whereby inadvertent pressing of said push button is avoided.

* * * * *